US009173533B1

(12) United States Patent
Theising

(10) Patent No.: US 9,173,533 B1
(45) Date of Patent: Nov. 3, 2015

(54) UPRIGHT VACUUM CLEANER

(71) Applicant: John L. Theising, St. Peters, MO (US)

(72) Inventor: John L. Theising, St. Peters, MO (US)

(73) Assignee: EMERSON ELECTRIC CO., St. Louis, MO (US)

( * ) Notice: Subject to any disclaimer, the term of this patent is extended or adjusted under 35 U.S.C. 154(b) by 0 days.

(21) Appl. No.: 14/314,735

(22) Filed: Jun. 25, 2014

(51) Int. Cl.

| | |
|---|---|
| ***A47L 9/10*** | (2006.01) |
| ***A47L 5/28*** | (2006.01) |
| ***A47L 9/12*** | (2006.01) |
| ***A47L 9/00*** | (2006.01) |
| ***A47L 9/02*** | (2006.01) |
| ***A47L 9/30*** | (2006.01) |
| ***A47L 9/14*** | (2006.01) |

(52) U.S. Cl.
CPC ..... *A47L 5/28* (2013.01); *A47L 9/0081* (2013.01); *A47L 9/02* (2013.01); *A47L 9/122* (2013.01); *A47L 9/1409* (2013.01); *A47L 9/30* (2013.01)

(58) Field of Classification Search
CPC ..... A47L 5/30; A47L 5/382; A47L 5/362; A47L 5/365; A47L 5/28; A47L 5/24; A47L 9/00; A47L 9/02; A47L 9/122; A47L 9/1409; A47L 9/0081
See application file for complete search history.

(56) References Cited

U.S. PATENT DOCUMENTS

| | | | | |
|---|---|---|---|---|
| 4,270,668 | A * | 6/1981 | Berfield | 220/324 |
| 5,987,697 | A * | 11/1999 | Song et al. | 15/324 |
| 6,289,552 | B1 * | 9/2001 | McCormick | 15/324 |
| 7,222,392 | B2 * | 5/2007 | McCormick et al. | 15/353 |
| 7,757,344 | B2 * | 7/2010 | Min et al. | 15/353 |
| 8,201,302 | B2 | 6/2012 | Poetting | |
| 8,272,097 | B2 | 9/2012 | Poetting | |
| 8,281,456 | B2 | 10/2012 | Finke | |
| 8,286,306 | B2 | 10/2012 | Vanini | |
| 8,344,562 | B2 * | 1/2013 | Kim | 310/51 |
| 8,424,155 | B2 | 4/2013 | Hawkins et al. | |
| 2009/0300872 | A1 * | 12/2009 | Griffith et al. | 15/347 |

* cited by examiner

*Primary Examiner* — Dung Van Nguyen
(74) *Attorney, Agent, or Firm* — Sutton McAughan Deaver, PLLC

(57) ABSTRACT

An upright vacuum cleaner with one or more features, such as a top opening rigid container, a headlight, a replaceable power cord a motor housing suspended within the vacuum to reduce noise and/or vibration a clutch assembly with a RPM sensor, and/or one or more filter plates to improve airflow.

59 Claims, 15 Drawing Sheets

UPRIGHT VACUUM CLEANER

CROSS REFERENCE TO RELATED APPLICATIONS

None.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to vacuum cleaners; and more specifically relate to upright vacuum cleaners.

2. Description of the Related Art

U.S. Pat. No. 8,424,155 teaches a "floor cleaning apparatus includes a body having a nozzle assembly and a canister assembly. The handle assembly is pivotally attached to the nozzle assembly. The nozzle assembly includes an agitator cavity that receives a rotary agitator. Both a suction generator and a dirt collection vessel are carried on the body. In addition, the vacuum cleaner includes an agitator lift assembly. The agitator lift assembly includes a sliding actuator and a fulcrum plate."

U.S. Pat. No. 8,286,302 teaches an "upright vacuum cleaner for cleaning a surface includes a base unit, a carriage configured to move the base unit on the surface, and an upper body having a dust collection container disposed therein. The upper body is supported so as to be tiltable relative to the base unit and is lockable in a parked position in which the vacuum cleaner has a substantially upright position when standing on the surface. A motor-fan unit is configured to provide a partial vacuum at the surface. An air conduit connecting the base unit and the dust collection container includes an interface and a section formed by a hose or an assembly of the hose and a wand. The section is connected downstream of the interface and is disposed at least partially externally on the upper body. The section is configured to enable a vacuuming mode of operation that is independent of the base unit. A tubular member forming at least part of a transition between the hose and the upper body. The tubular member is swivelably disposed on the upper body."

U.S. Pat. No. 8,281,456 teaches an "upright vacuum cleaner for cleaning a surface includes an upper body with a handle, a base unit and a carriage configured to move the base unit on the surface. The carriage includes a wheel disposed in a rear portion of the base unit. A motor-fan unit is disposed in the base unit and configured to create a partial vacuum at the surface. A tilting joint provides for relative tilting between the upper body and the base unit. The tilting joint has a pivot axis extending in a horizontal direction when the vacuum cleaner is in a position of use. The wheel is mounted on a pivotable carrier member, which has a pivot axle that is spaced apart from a rotatable axle of the wheel. A pivoting mechanism is disposed on the tilting joint in a vicinity of the carrier member and is configured to pivot the carrier member and the wheel during a pivoting movement of the upper body relative to the base unit."

U.S. Pat. No. 8,272,097 teaches an "upright vacuum cleaner for cleaning a surface includes an upper body having a dust collection container received therein, a base unit and a carriage configured to provide movement of the base unit on the surface. A motor-fan unit is disposed in the base unit and configured to create a partial vacuum at the surface. A rigid, yoke-shaped duct member provides at least a portion of an air path from the base unit to the upper body. The yoke-shaped duct member supports the upper body such that the upper body is pivotable relative to the base unit about a tilt axis extending horizontally when the upright vacuum cleaner is in a position of use."

U.S. Pat. No. 8,201,302 teaches an "upright vacuum cleaner for cleaning a surface includes an upper body with a dust collection container received therein, and a base unit. A carriage is configured to provide movement of the base unit on the surface. A motor-fan unit is disposed in the base unit and configured to provide a partial vacuum at the surface. The upper body is connected to the base unit by a tilting joint such that the upper body and base unit are tiltable relative to each other about a tilt axis extending horizontally when the upright vacuum cleaner is in a position of use. An air conduit is disposed rotatably with respect to the motor-fan unit and communicates with a suction side of the motor-fan unit."

The inventions disclosed and taught herein are directed to advanced features for an upright vacuum cleaner.

BRIEF SUMMARY OF THE INVENTION

An upright vacuum cleaner with a fan configured to induce airflow through the vacuum cleaner and lift debris entrained in the airflow, and a motor configured to drive the fan. The vacuum cleaner also includes a floor engaging power head with an opening through which the airflow enters the power head and ingests debris entrained in the airflow into the vacuum, and a brush configured to agitate the debris and thereby assist in lifting and entraining the debris in the airflow. The vacuum cleaner may include a main support rotatably secured to the power head at a first end with a handle at an opposing second end, and a control switch configured to selectively apply power to the motor. The vacuum cleaner preferably includes a container assembly configured to filter the airflow and thereby collect the debris entrained in the airflow. The container assembly may include a container secured to the main support, a door rotatably secured to the container, and a latch assembly including a cam lock rotatably secured to the door and configured to selectively engage the main support and thereby hold the door closed, such that the door is in sealing engagement with the container.

The latch assembly may include at least one stop positioned to limit rotation of the cam lock and/or at least one spring configured to bias the cam lock in a select position. More specifically, the cam lock may include a substantially cylindrical portion, about which the cam lock rotates, having an curved outer surface and at least one flat surface formed in the curved outer surface positioned to engage the spring and thereby bias the cam lock in the selected position.

The vacuum cleaner is preferably designed to make operation thereof clear to even an untrained operator. For example, the door may be colored a contrasting color with respect to the cam lock, thereby making the cam lock easily distinguishable from the door and operation of the latch assembly readily apparent.

The vacuum cleaner may include a headlight assembly to project light forward of the power head. The headlight assembly may include an array of light emitting diodes (LEDs) and/or other lighting elements mounted on a flexible strip.

The headlight assembly may also include a lens strip and/or a foam backing, such that the flexible strip of the headlight assembly may be secured between the foam backing and the lens strip. More specifically, the lights may be positioned behind one or more apertures in a forwardly facing surface of the power head. In this manner, the LEDs may be positioned to project light through the lens strip and through the one or more apertures.

The upright vacuum cleaner may also include an easily replaceable power cord to reliably deliver power to the motor. The cord may include one end terminating in a standard wall plug configured to engage a standard wall power outlet. The cord may also include another end terminating in a removable plug secured to a power inlet receptacle of the vacuum cleaner. The removable plug may include a strain relief. The removable plug preferably includes a slot positioned to engage a screw, bolt, or other removable fastener normally secured to the power inlet receptacle of the vacuum cleaner. Thus, the removable fastener may removably secure the removable plug within the power inlet receptacle, thereby removably securing the cord to the vacuum cleaner. Of course, removing the fastener allows the removable plug to be removed from the power inlet receptacle, thereby permitting replacement of the cord by removing the fastener.

In order to reduce noise and/or vibration, motor of the vacuum cleaner may be mounted within a motor housing suspended within the vacuum. For example, the vacuum cleaner may include vibration absorbing mounts securing the motor within the housing and securing the housing within the vacuum cleaner. Additionally, or alternatively, the vacuum cleaner may include sound absorbing foam between the motor housing and the motor, and/or between the motor housing and a main body of the vacuum cleaner. The vacuum cleaner may also include a pressure sensor configured to indicate status information related to the airflow. This sensor may be mounted to the motor housing, or elsewhere.

In some embodiments, the motor also drives a clutch assembly which in turn drives the brush. The clutch assembly may also include a revolution per minute (RPM) sensor configured to indicate status information related to the brush.

In some embodiments, the vacuum cleaner includes an extension assembly, which may include a flexible hose removably secured to the container assembly and a wand removably alongside the container assembly. The wand may include a lip to engage a matching projection secured to the container assembly to hold the wand in position relative to the container assembly.

The container comprises one or more side walls defining a space, within which a filter bag may be removably secured. The airflow preferably flows into an opening of power head, through the power head. The airflow may flow through the extension assembly, or otherwise, flow into the container assembly, through the main body, past the fan and out of the vacuum. In some embodiments, the container includes one or more filter plates offset within the container, between the sidewall and the filter bag. In this case, the airflow may flow into the container through the filter bag, filter plate, and then out of the container towards the fan.

DETAILED DESCRIPTION OF THE INVENTION

Figure 1:
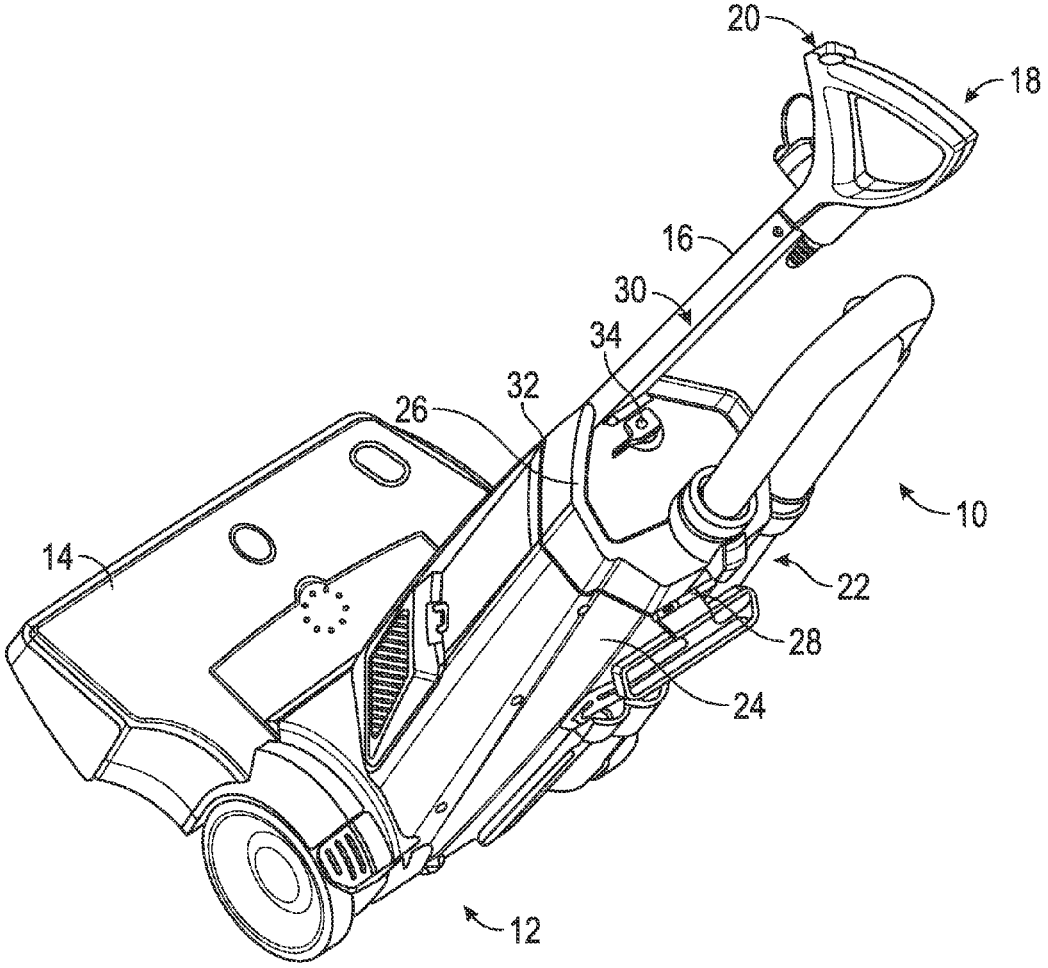
FIG. 1 illustrates a perspective view of a particular embodiment of an upright vacuum cleaner utilizing certain aspects of the present inventions.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Applicants have created an upright vacuum cleaner with a fan configured to induce airflow through the vacuum cleaner and lift debris entrained in the airflow, and a motor configured to drive the fan. The upright vacuum cleaner of the present invention may also include a status display, or otherwise be similar to that of application Ser. No. 14/273,811, filed, May 9, 2014, entitled "Display for Vacuum Cleaner". The vacuum cleaner also includes a floor engaging power head with an opening through which the airflow enters the power head and ingests debris entrained in the airflow into the vacuum, and a brush configured to agitate the debris and thereby assist in lifting and entraining the debris in the airflow. The vacuum cleaner may include a main support rotatably secured to the power head at a first end with a handle at an opposing second end, and a control switch configured to selectively apply power to the motor. The vacuum cleaner preferably includes a container assembly configured to filter the airflow and thereby collect the debris entrained in the airflow. The container assembly may include a container secured to the main support, a door rotatably secured to the container, and a latch assembly including a cam lock rotatably secured to the door and configured to selectively engage the main support and thereby hold the door closed, such that the door is in sealing engagement with the container.

The latch assembly may include at least one stop positioned to limit rotation of the cam lock and/or at least one spring configured to bias the cam lock in a select position. More specifically, the cam lock may include a substantially cylindrical portion, about which the cam lock rotates, having a curved outer surface and at least one flat surface formed in the curved outer surface positioned to engage the spring and thereby bias the cam lock in the selected position.

The vacuum cleaner is preferably designed to make operation thereof clear to even an untrained operator. For example, the door may be colored a contrasting color with respect to the cam lock, thereby making the cam lock easily distinguishable from the door and operation of the latch assembly readily apparent.

The vacuum cleaner may include a headlight assembly to project light forward of the power head. The headlight assembly may include an array of light emitting diodes (LEDs) and/or other lighting elements mounted on a printed circuit board or flexible LED strip. The headlight assembly may also include a lens strip and/or foam backing, such that the LED strip of the headlight assembly may be secured between the foam backing and the lens strip. More specifically, the lights may be positioned behind one or more apertures in a forwardly facing surface of the power head. In this manner, the LEDs may be positioned to project light through the lens strip and through the one or more apertures.

The upright vacuum cleaner may also include an easily replaceable power cord to reliably deliver power to the motor. The cord may include one end terminating in a standard wall plug configured to engage a standard wall power outlet. The cord may also include another end terminating in a removable plug secured to a power inlet receptacle of the vacuum cleaner. The removable plug may include a strain relief. The removable plug preferably includes a slot positioned to engage a screw, bolt, or other removable fastener normally secured to the power inlet receptacle of the vacuum cleaner. Thus, the removable fastener may removably secure the removable plug within the power inlet receptacle, thereby removably securing the cord to the vacuum cleaner. Of course, removing the fastener allows the removable plug to be removed from the power inlet receptacle, thereby permitting replacement of the cord by removing the fastener.

In order to reduce noise and/or vibration, motor of the vacuum cleaner may be mounted within a motor housing suspended within the vacuum. For example, the vacuum cleaner may include vibration absorbing mounts securing the motor within the housing and securing the housing within the vacuum cleaner. Additionally, or alternatively, the vacuum cleaner may include sound absorbing foam between the motor housing and the motor, and/or between the motor housing and a main body of the vacuum cleaner. The vacuum cleaner may also include a pressure sensor configured to indicate status information related to the airflow. This sensor may be mounted to the motor housing, or elsewhere.

In some embodiments, the motor also drives a clutch assembly which in turn drives the brush. The clutch assembly may also include a revolution per minute (RPM) sensor configured to indicate status information related to the brush.

In some embodiments, the vacuum cleaner includes an extension assembly, which may include a flexible hose removably secured to the container assembly and a wand removably alongside the container assembly. The wand may include a lip to engage a matching projection secured to the container assembly to hold the wand in position relative to the container assembly.

The container comprises one or more side walls defining a space, within which a filter bag may be removably secured. The airflow preferably flows into an opening of power head, through the power head. The airflow may flow through the extension assembly, or otherwise, flow into the container assembly, through the main body, past the fan and out of the vacuum. In some embodiments, the container includes one or more filter plates offset within the container, between the sidewall and the filter bag. In this case, the airflow may flow into the container through the filter bag, filter plate, and then out of the container towards the fan.

FIG. 1 is an illustration of an upright vacuum cleaner 10 according to certain aspects of the present invention. The vacuum cleaner 10 includes a base 12 or main body housing a fan (not shown) to induce airflow through the vacuum cleaner 10 and lift debris entrained in that airflow. The vacuum cleaner 10 also includes a motor (not shown) configured to drive the fan.

In most embodiments, the vacuum cleaner 10 will include a floor engaging power head 14 rotatably secured to the main body. The power head 14 preferably includes an opening through which the airflow enters the power head 14 and ingests debris entrained in the airflow into the vacuum 10. In some embodiments, the power head 14 will include a brush (not shown) configured to agitate the debris and thereby assist in lifting and entraining the debris in the airflow. The brush may be fixed, or it may be rotating—driven by the motor, or another motor.

The vacuum cleaner 10 may also include a main support 16 secured to the main body 12 and thereby rotatably secured to the power head 14 at one end with a handle 18 at the other end. In most embodiments, a control switch 20 will be located near or as part of the handle 18 to selectively apply power to the motor.

The vacuum cleaner 10 also includes a container assembly 22 configured to filter the airflow and thereby collect the debris entrained in the airflow. The container assembly 22 may be secured to the main support 16 or may be independently secured to the base or main body 12. In any case, the container assembly 22 preferably includes a container 24 to collect the debris and a door 26 rotatably secured to the container 24, such as by one or more hinges 28. In most embodiments, the container 24 is rigid. In some embodiments, the door 26 is located on, at, or near the top of the container 24. In most embodiments, the container assembly 22 includes a latch assembly 30 to secure the door 26 closed, such that the container 24 is sealed substantially airtight. To facilitate the airtight seal, the container assembly 22 may include a gasket 32 positioned between the door 26 and the container 24.

Figure 2:
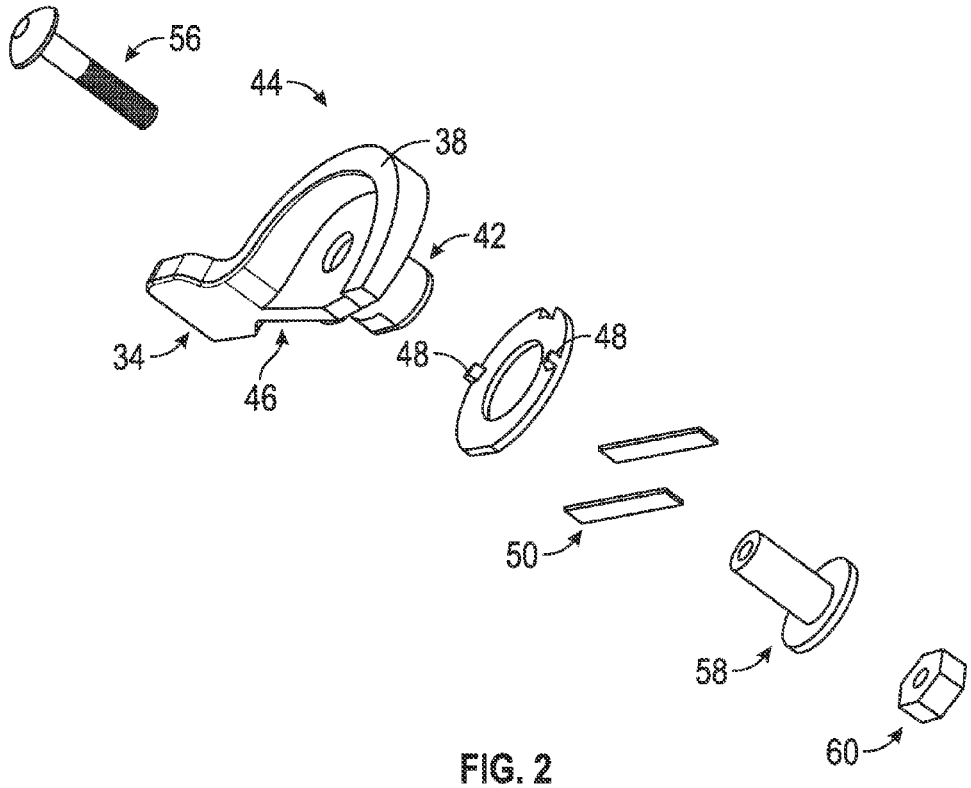
FIGS. 2-3 illustrate exploded views of portions of a particular embodiment of a latch assembly of an upright vacuum cleaner utilizing certain aspects of the present inventions.
Figure 3:
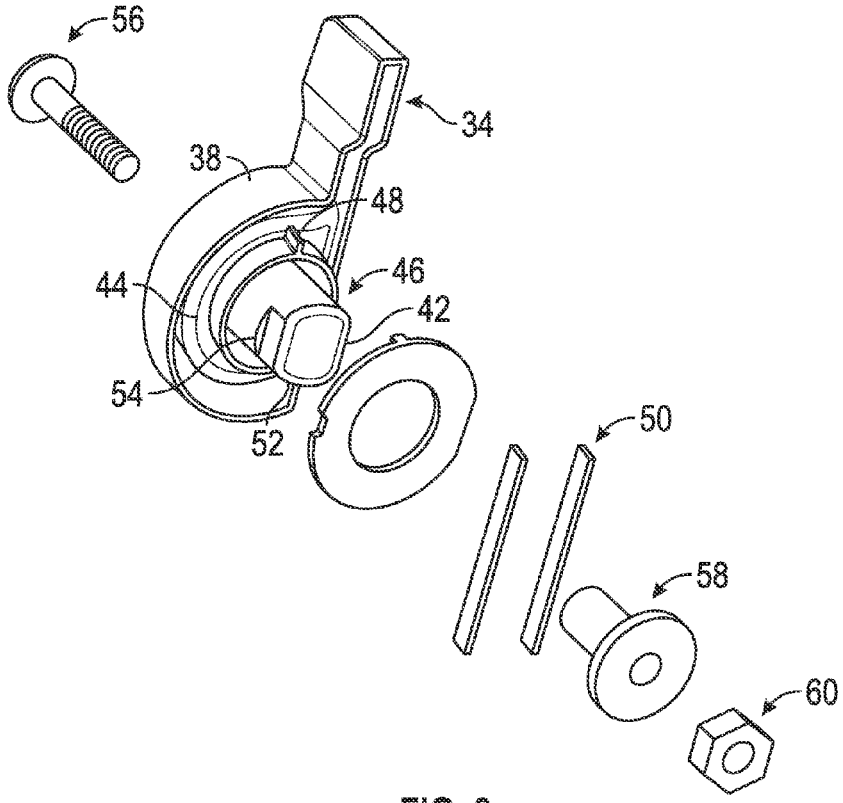
Figure 4:
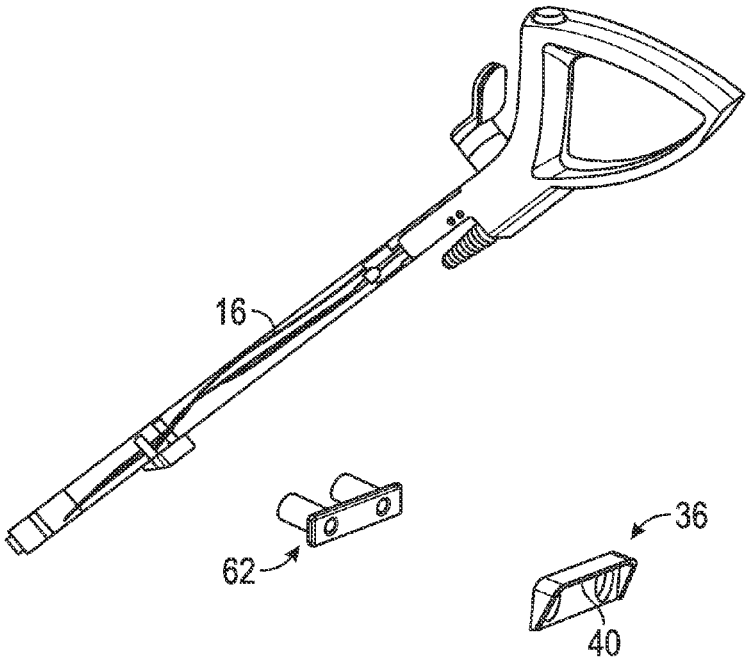
FIGS. 4-5 illustrate perspective views of portions of a particular embodiment of a latch assembly of an upright vacuum cleaner utilizing certain aspects of the present inventions.
Figure 5:
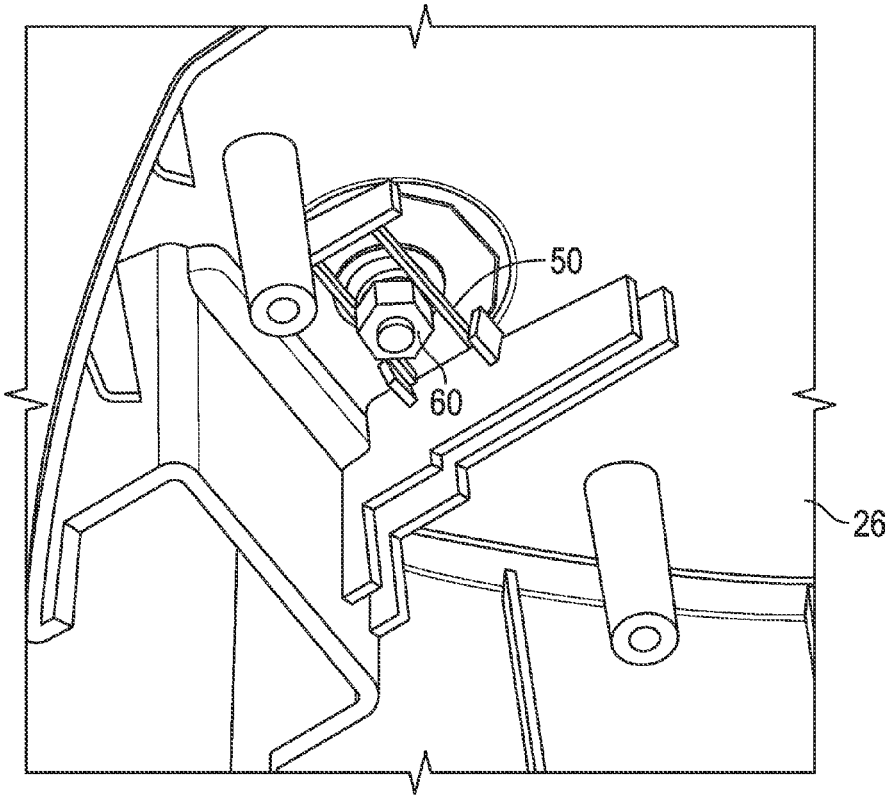
Figure 6:
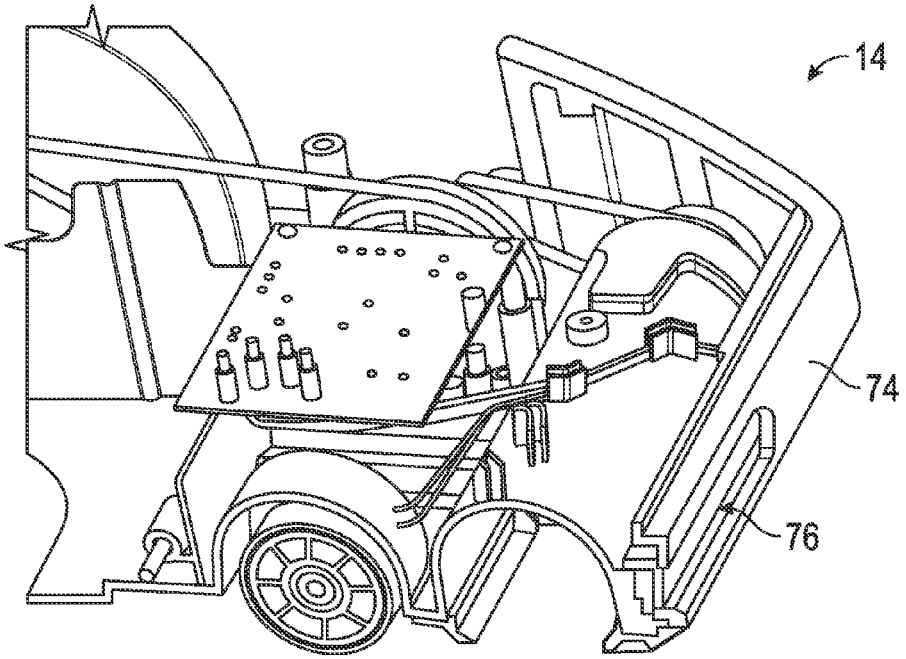
FIGS. 6-11 illustrate perspective views of portions of a particular embodiment of a headlight assembly of an upright vacuum cleaner utilizing certain aspects of the present inventions.
Figure 7:
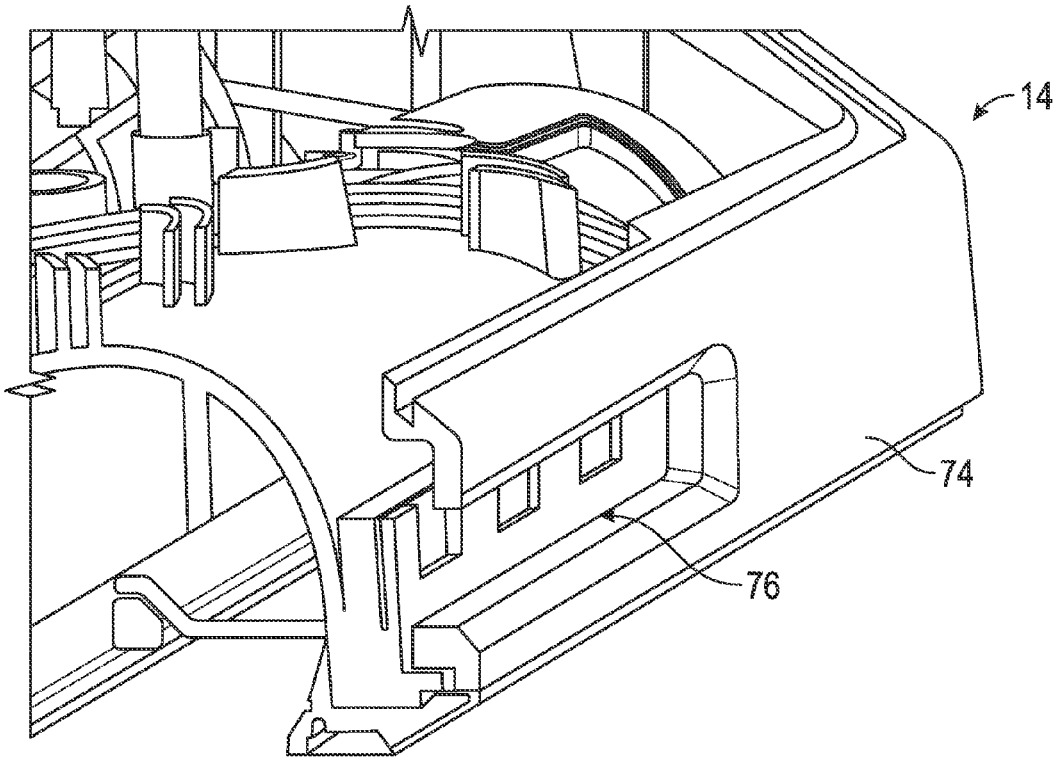
Figure 8:
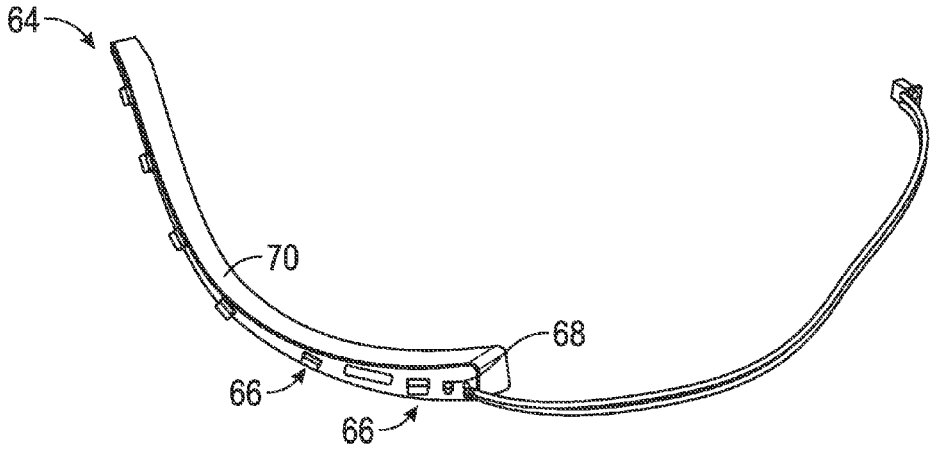
Figure 9:
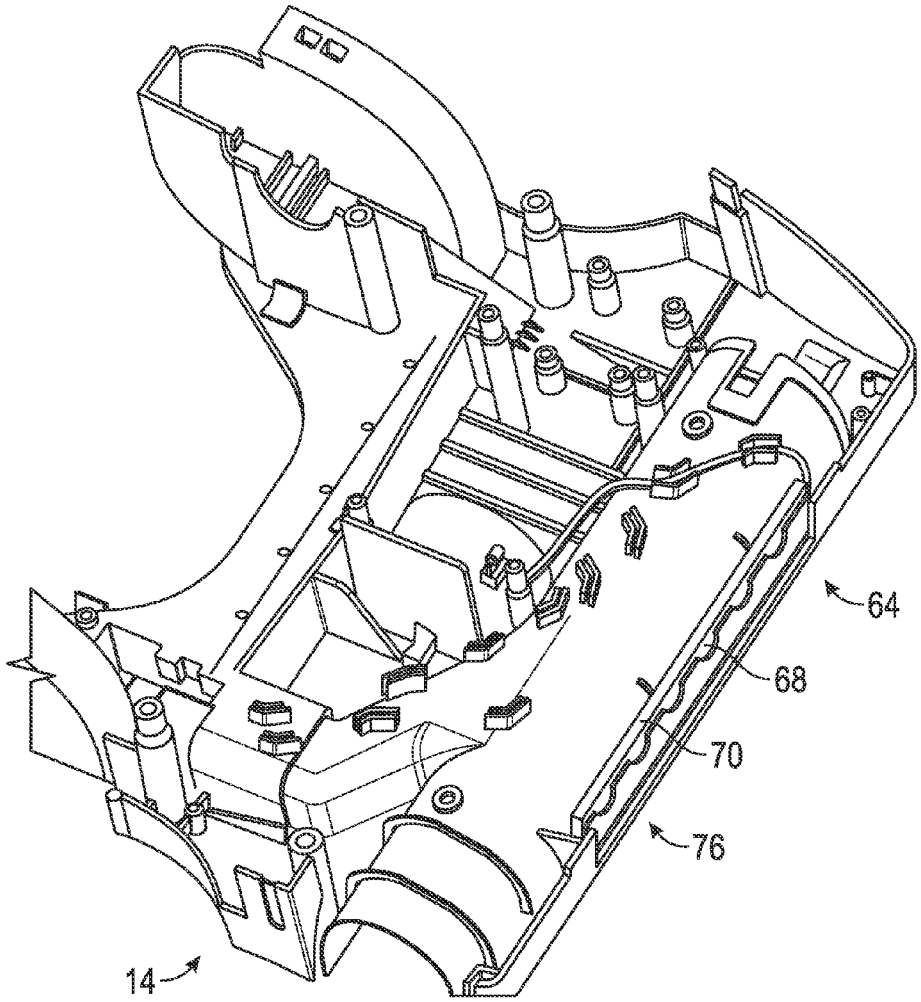
Figure 10:
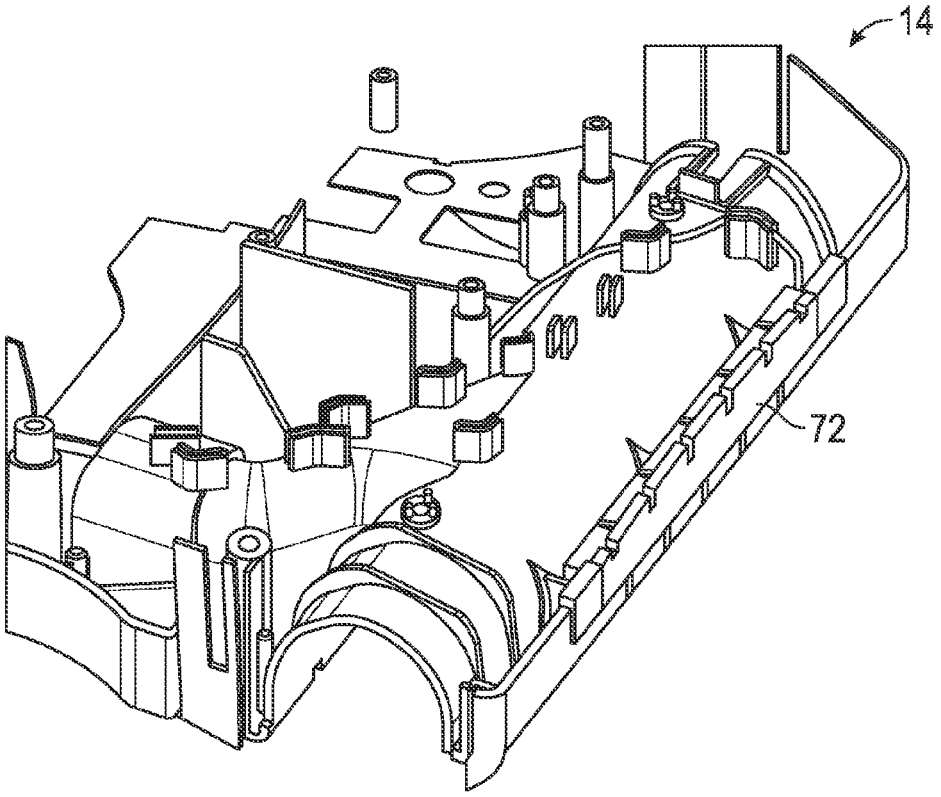
Figure 11:
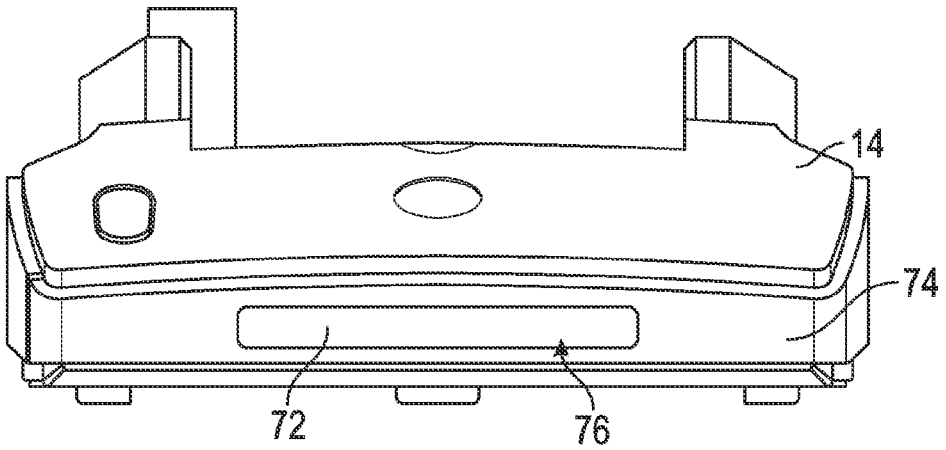
Figure 12:
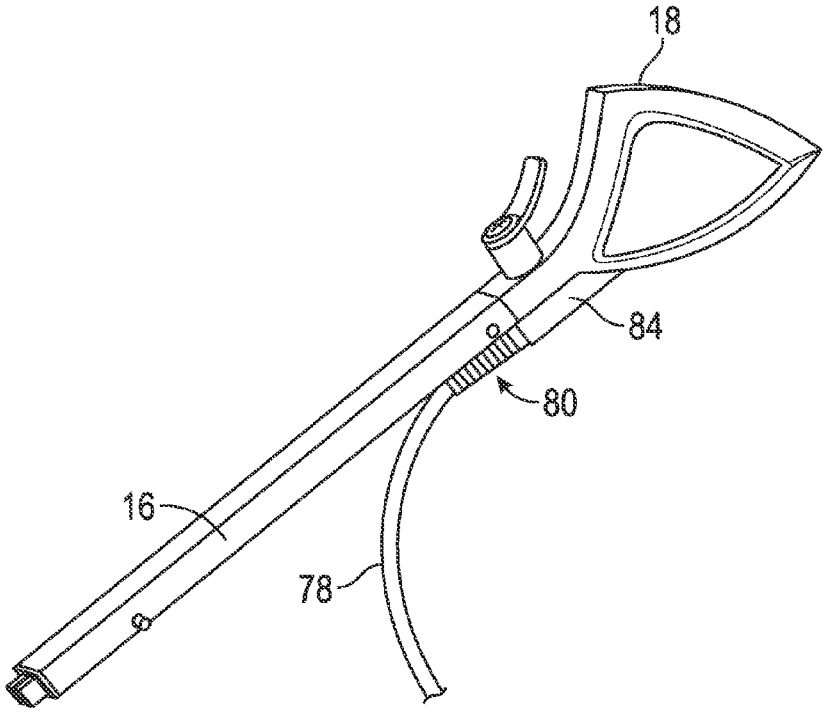
FIGS. 12-15 illustrate perspective views of portions of a particular embodiment of a power cord assembly of an upright vacuum cleaner utilizing certain aspects of the present inventions.
Figure 13:
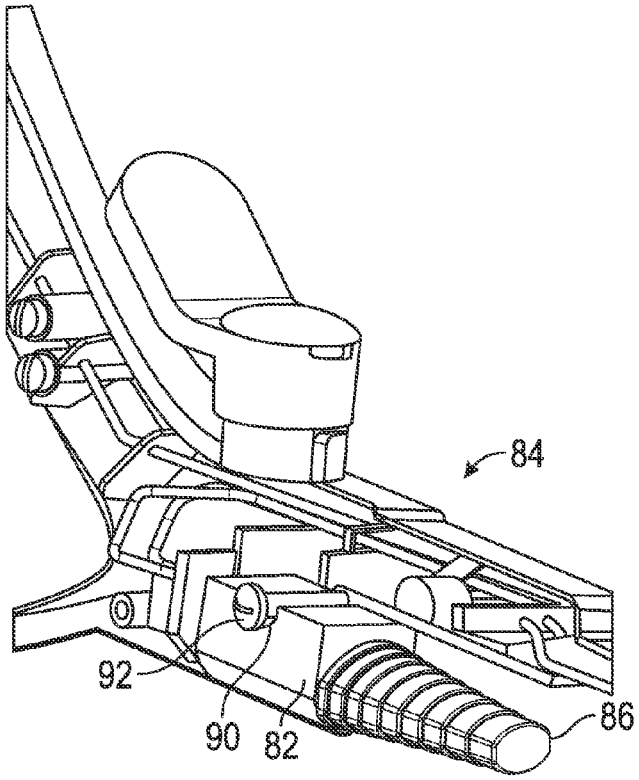
Figure 14:
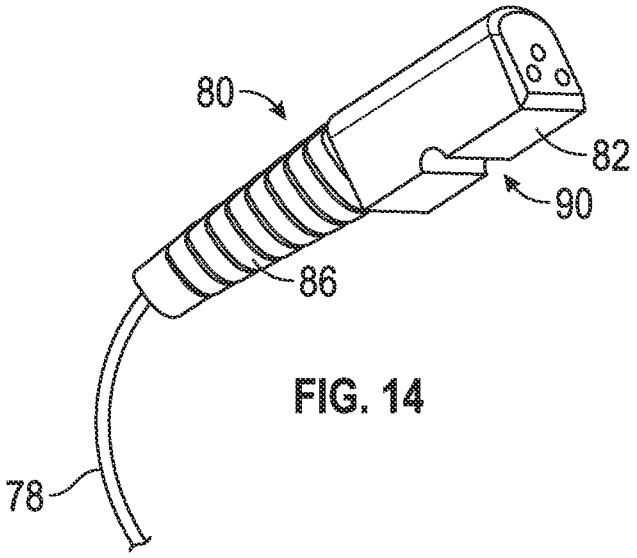
Figure 15:
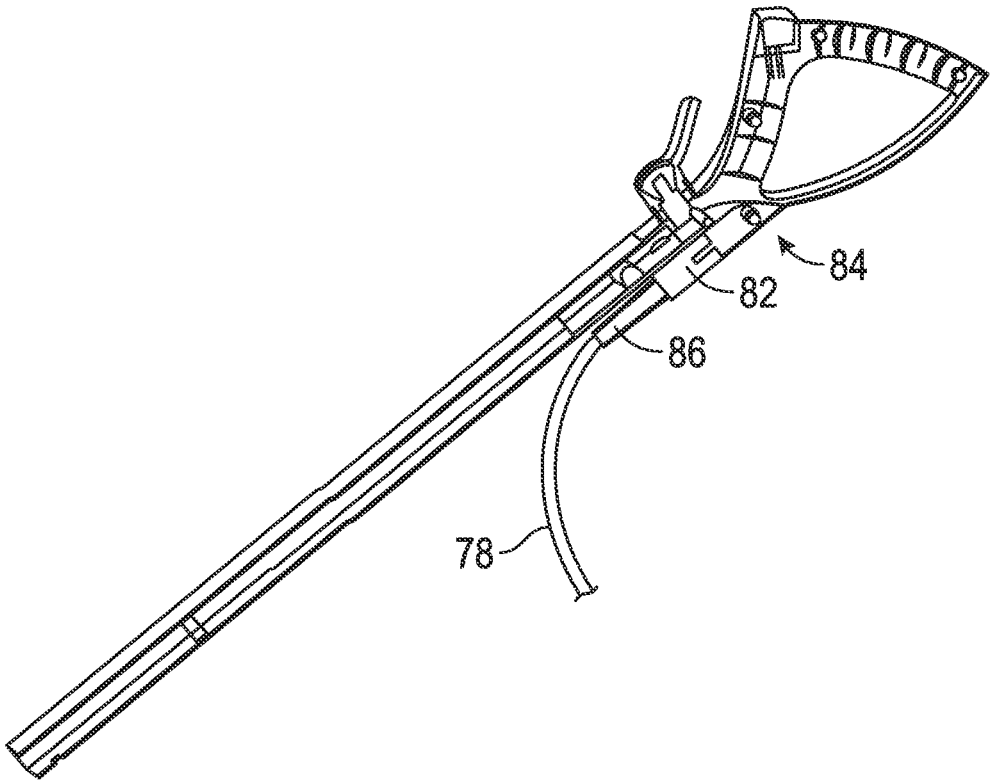
Figure 16:
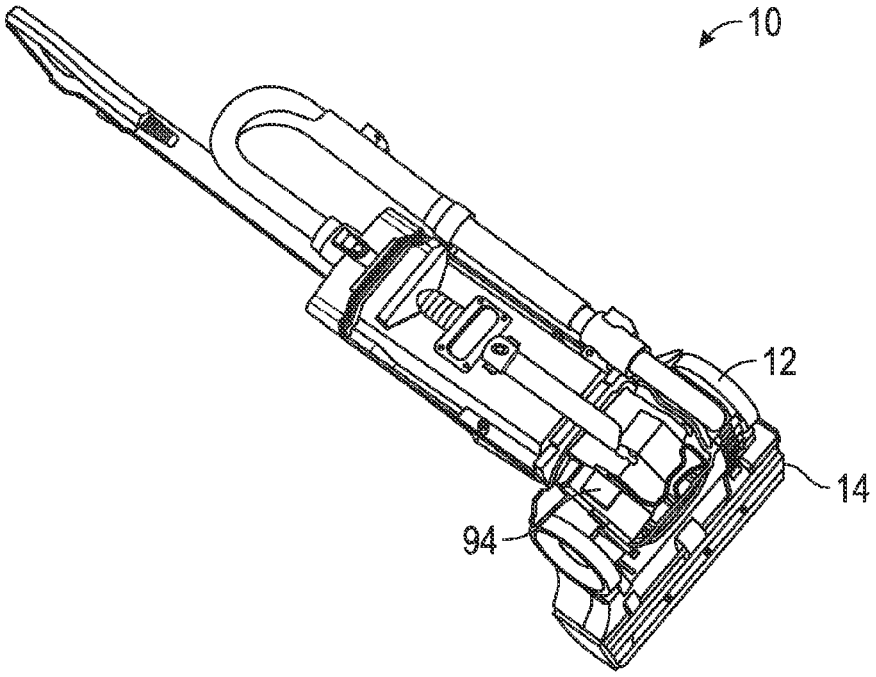
FIGS. 16-19 illustrate perspective views of portions of a particular embodiment of a motor assembly of an upright vacuum cleaner utilizing certain aspects of the present inventions.
Figure 17:
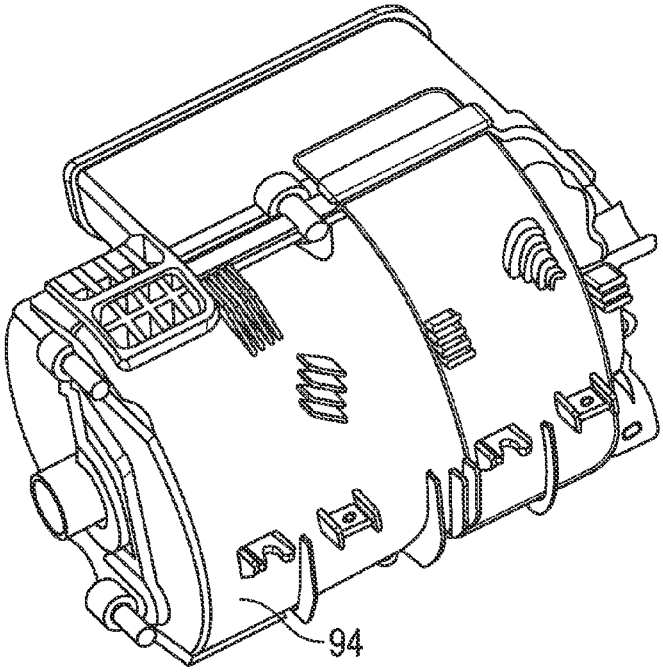
Figure 18:
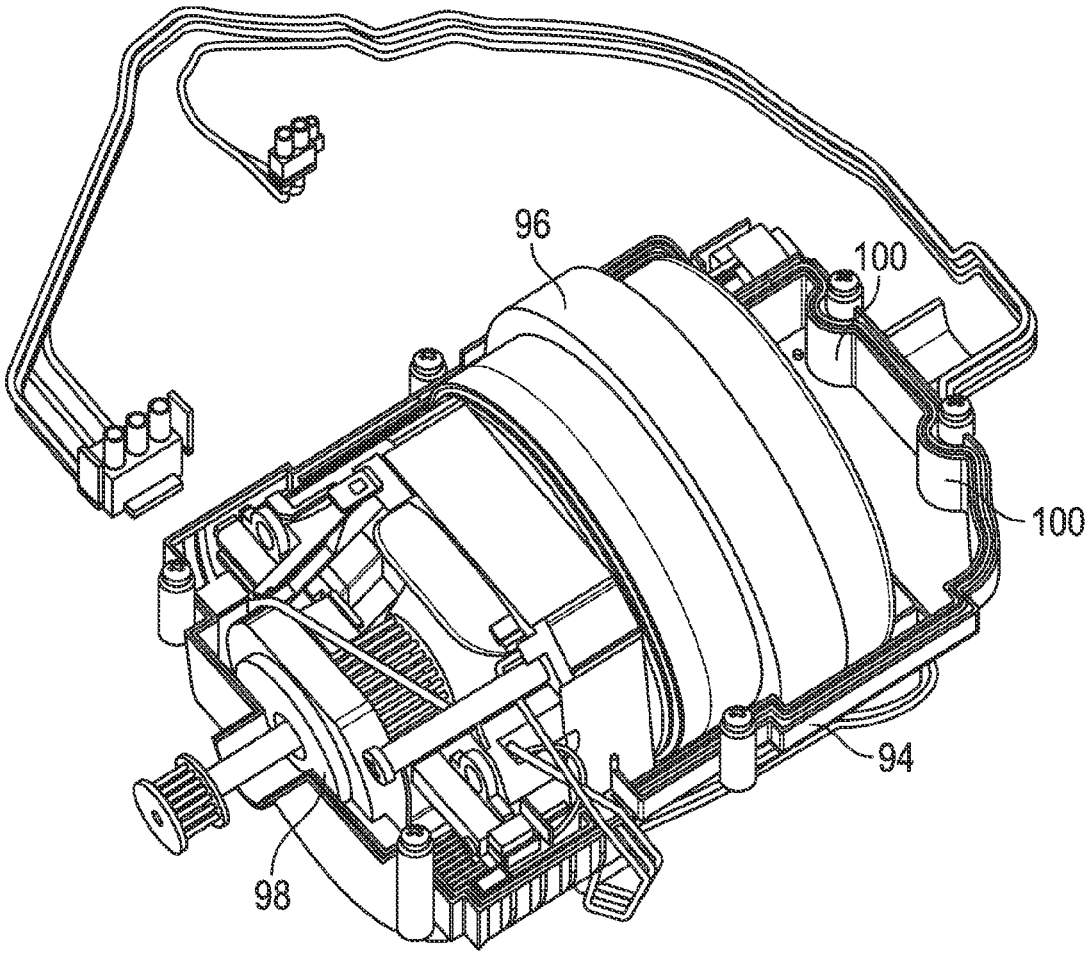
Figure 19:
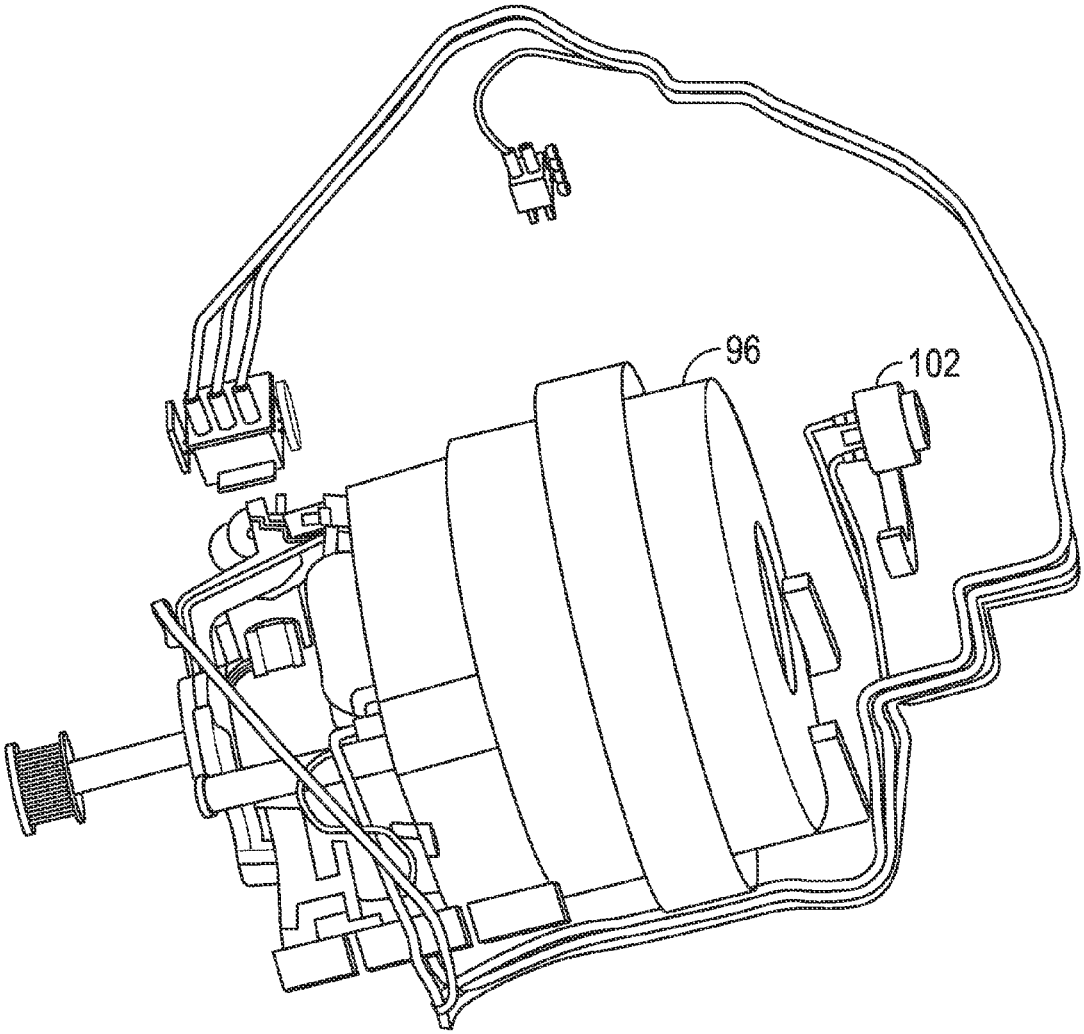

In one embodiment, referring also to FIG. 2 and FIG. 3, the latch assembly 30 includes a cam lock 34 rotatably secured to the door 26 and configured to selectively engage the main support 16 and thereby hold the door 26 closed, such that the door 26 is in sealing engagement with the container 24. Referring also to FIG. 4, the cam lock 34 may be rotated to engage a latch 36 secured to the main support 16 and positioned to engage the cam lock 34 to hold the door 26 closed. Still more specifically, the cam lock 34 may include a wedge 38 slidably engaging a protrusion 40 of the latch 36 to bias the door 26 toward the container 24 and compress the gasket 32 thereby sealing the door 26 to the container 24.

As shown, the cam lock 34 may include a substantially cylindrical portion 42 defining an axis of rotation about which the cam lock 34 rotates and a substantially planar portion 44. The wedge 38 is preferably arcuate and positioned around a portion of the outer circumference of the substantially planar portion 44 to engage the latch 36, when the cam lock 34 is rotated to the closed position. The substantially planar portion 44 may also have a flat portion 46 of the outer circumference to allow the cam lock 34 to freely past the latch 36, when the cam lock 34 is rotated to the open position.

The latch assembly may also include one or more stop(s) 48 positioned to limit rotation of the cam lock 34. For example, a stop 48 may be located on the cam lock 34 and normally riding in an arcuate slot in the door 26, with the slot configured to engage the stop 48 to limit rotation of the cam lock 34. Alternatively, a stop 48 may be located on the door 26 and normally riding in an arcuate slot in the cam lock 34, with the slot configured to engage the stop 48 to limit rotation of the cam lock 34.

The latch assembly 30 may also include one or more springs 50 to bias the cam lock 34 in either the open or closed position. For example, the cylindrical portion 42 of the cam lock 34 may include a curved outer surface 52 with one or more flat portions 54 formed in the curved outer surface 52 and positioned to engage the spring(s) 50 and thereby bias the cam lock 34 in the select position.

In one embodiment, the cam lock 34 is secured to the door 26 via a screw, bolt, or other fastener 56 extending through the substantially planar portion 44, cylindrical portion 42, and the door 26. A spacer 58 may be used to ensure easy of rotation of the cam lock 34 and prevent backing out of the screw 56. In any case, the bolt 56 may be held in place with a nut 60. Likewise, the latch 36 may be secured to the support 16, or other portion of the vacuum 10, using one or more fasteners and an expanding nut block 62, i.e. as a screw or other fastener is threaded into the nut block 62, the block 62 expands, thereby securing the latch to the support 16.

The upright vacuum cleaner 10 is preferably simple to operate with little or no training. Therefore, components of the vacuum cleaner 10 are preferable designed to make their function and operation readily apparent. For example, the door 26 and the cam lock 34 may be colored in contrasting colors, thereby making the cam lock 34 readily distinguishable from the door 26 and operation of the latch assembly 30 instantly recognizable.

The upright vacuum cleaner 10 preferably includes convenience and/or ease of use features. For example, referring also to FIG. 6, FIG. 7, FIG. 8, FIG. 9, FIG. 10, and FIG. 11, the vacuum cleaner 10 may include a headlight assembly 64 positioned to project light forward of the power head 14. In one embodiment, the headlight assembly 64 comprises an array of light emitting diodes (LEDs) 66 mounted on a LED strip 68. The LED strip 68 may include one or more rigid printed circuit boards, or may be flexible. In any case, the LED strip 68 may be mounted on the power head 14 via a foam backing 70. The headlight assembly 64 may further include a lens strip 72 such that LED strip 68 of the headlight assembly 64 secured between the foam backing 70 and the lens strip 72.

More specifically, the power head 14 may have a forwardly facing surface 74 with one or more apertures 76 therein. The forwardly facing surface 74 may be substantially flat, vertically and/or horizontally, and may be substantially planar. The LEDs 66 are preferably positioned to project light through the lens strip 72, if one is included, and through the aperture(s) 76.

The upright vacuum cleaner 10 is also preferably durable and easy to repair. For example, referring also the FIG. 12, FIG. 13, FIG. 14, and FIG. 15, one of the most abused components of a vacuum 10 is its power cord 78. A power cord 78 is used to deliver power from some sort of source to the motor, and other power consuming components. In some embodiments, the power cord 78 of the present invention includes a first end terminating in a first plug configured to engage a power outlet, such as a standard plug designed to engage a standard wall outlet. A second end 80 of the cord 78 may terminate in an inlet plug 82 configured to engage a power inlet 84 of the vacuum cleaner 10. In this manner, the power cord 78 may be replacable. In most embodiments, the inlet plug 82 will include a durable strain relief 86. In some embodiments, the inlet plug 82 and/or the strain relief 86 may have a slot 90 therein to engage a removable fastener 92 of the vacuum cleaner 10. In that case, the inlet plug 82 may be inserted into the power inlet 84 of the vacuum cleaner 10 and then the fastener 92 may be inserted through the slot 90 and secured, thereby securing the cord 78 to the vacuum cleaner 10 with the inlet plug 82 and fastener 92 installed. Of course, removing the fastener 92 would permit removal of the inlet plug 82 from the power inlet 84, thereby allowing easy replacement of the cord 78 by simply removing the fastener 92.

The upright vacuum cleaner 10 is also preferably quiet and relatively vibration free, thereby reducing fatigue of the operator. In some embodiments, referring also to FIG. 16, FIG. 17, FIG. 18, and FIG. 19, the vacuum cleaner 10 may include a motor housing 94 containing the motor 96 and mounted within the base or main body 12, rather than having the motor 96 mounted directly within the main body 12. This provides a further layer of sound and/or vibration isolation. Furthermore, the housing 94 may include one or more vibration absorbing mounts 98 securing the motor 96 within the housing 94 and/or securing the housing 94 within the main body 12. Alternatively, or additionally, the housing 94 may include sound absorbing foam 100 between the motor housing 94 and the motor 96 and/or between the motor housing 94 and the main body 12. The motor housing 94 may include a pressure sensor 102 configured to indicate status information related to the airflow.

Figure 20:
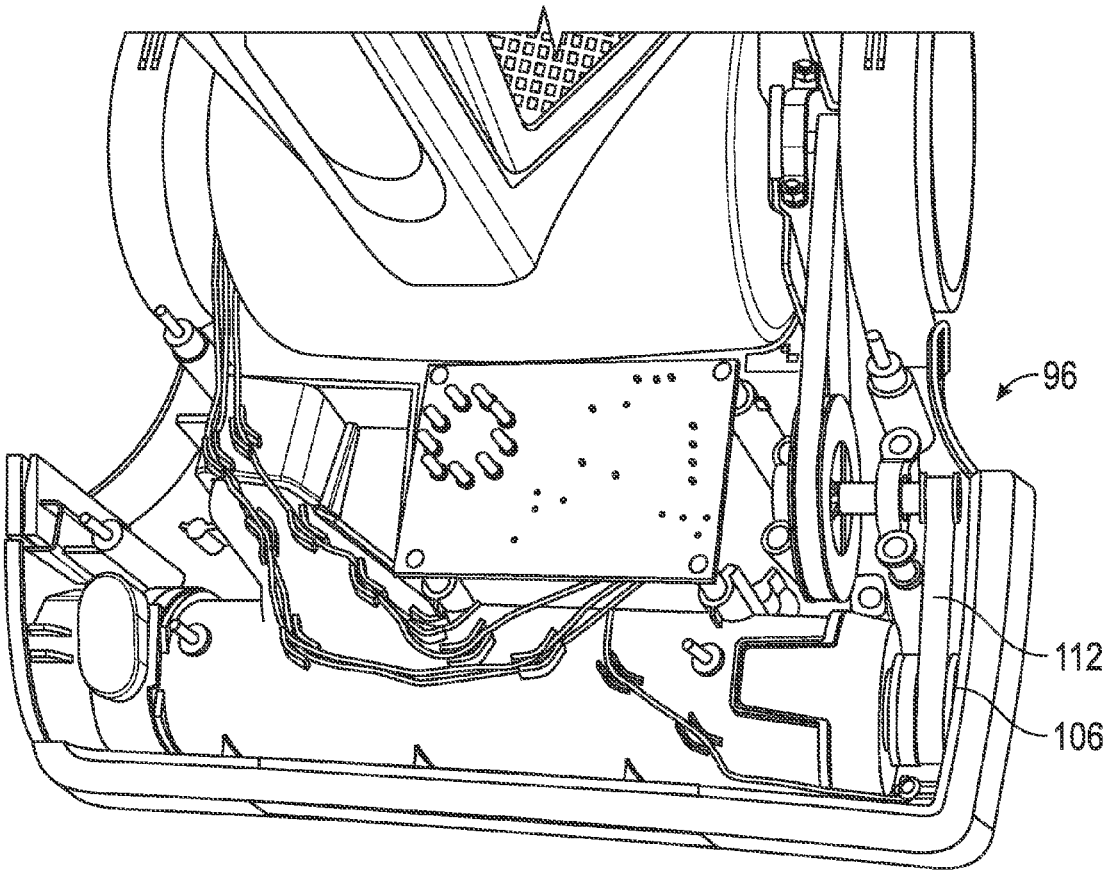
FIGS. 20-22 illustrate perspective views of portions of a particular embodiment of a clutch assembly of an upright vacuum cleaner utilizing certain aspects of the present inventions.
Figure 21:
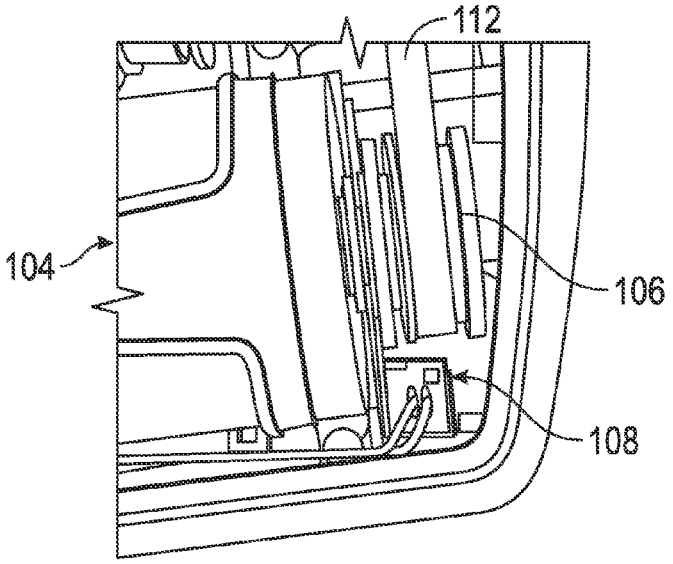
Figure 22:
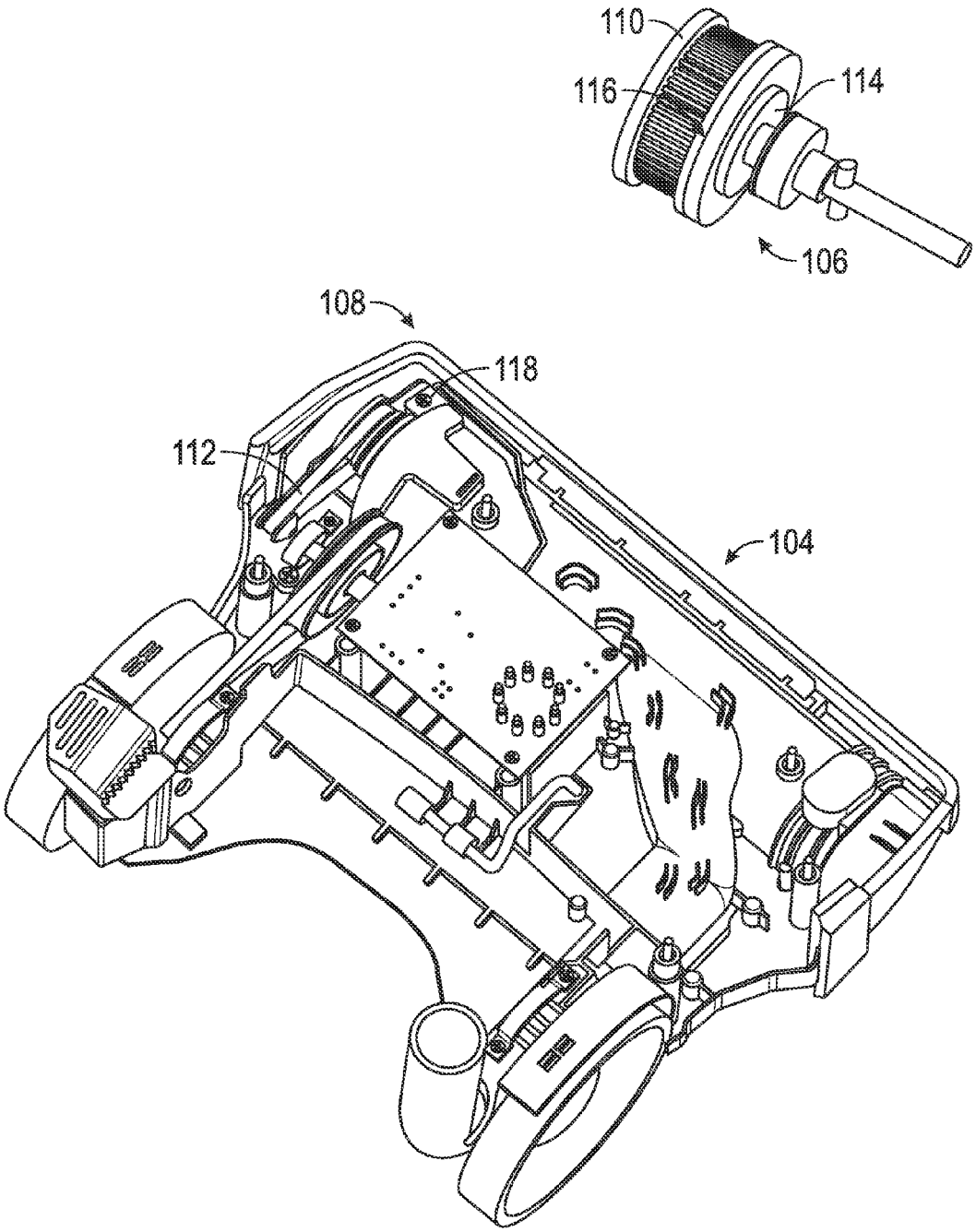

In many embodiments, referring also to FIG. 20, FIG. 21, and FIG. 22, the motor 96 will also drive the brush 104. More specifically, in one embodiment, the motor 96 also drives a clutch assembly 106 which in turn drives the brush 104. The clutch assembly 106 may include a revolution per minute (RPM) sensor 108 configured to indicate status information related to the brush 104. For example, the clutch assembly 106 may include an input wheel 110 coupled to the motor 96, directly or through a belt 112. The clutch assembly 106 also preferably includes an output wheel 114 that drives the brush 104, directly or through a belt 112. The RPM sensor may include a magnet 116 secured to output wheel 114 and a magnetic sensor 118 secured to the motor housing or other portion of the vacuum, such as the power head 14. In this manner the RPM sensor 108 may be used to indicate when the clutch 106 is slipping.

Figure 23:
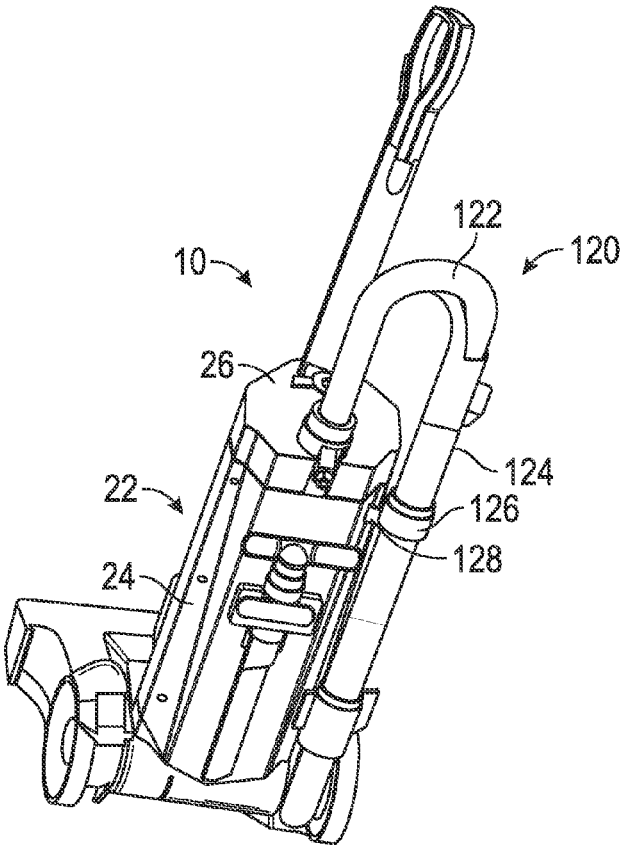
FIGS. 23-25 illustrate perspective views of portions of a particular embodiment of an extension assembly of an upright vacuum cleaner utilizing certain aspects of the present inventions.
Figure 24:
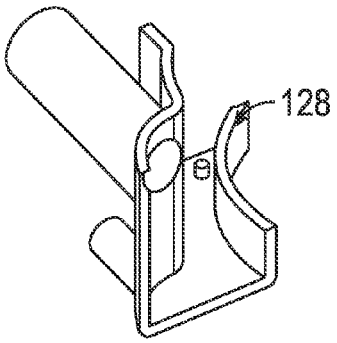
Figure 25:
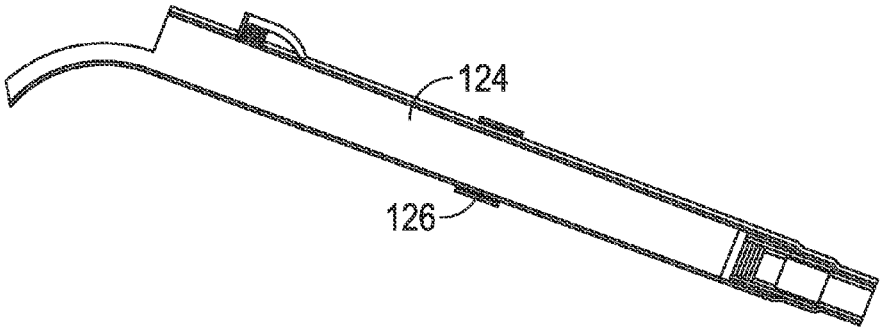

Referring also to FIG. 23, FIG. 24, and FIG. 25, the upright vacuum cleaner 10 may also include an extension assembly 120. For example, the extension assembly 120 may include a flexible hose 122 removably secured to the container assembly 22 and a wand 124 removably secured alongside the container assembly 22. More specifically, the flexible hose 122 may be removably secured to the door 26, or another top or upper portion of the container 24. The wand 124 may be removably secured alongside the container 24, such that it is normally in fluid communication with the power head 14.

Thus, in normal operation the airflow flows into the opening of power head 14, through the power head 14, through the extension assembly 120, into the container assembly 22, through the main body 12, past the fan and out of the vacuum 10, in that order. Of course, other airflows are possible. For example, the airflow may flow into the opening of power head 14, through the power head 14 past the fan, through the extension assembly 120, into the container assembly 22 and out of the vacuum 10, in that order.

The wand 124 may be removed from fluid communication with the power head 14, as needed to reach areas that would be hard to reach with the power head 14. The wand 124 is preferably secured to the container assembly 22 in such a manner as to allow for easy and intuitive removal and replacement, without sharp edges and snag point. For example, the wand 124 may include an arcuate lip 126 that engages an arcuate projection 128 of the container assembly 22 to hold the wand 124 in position relative to the container assembly 22.

Figure 26:
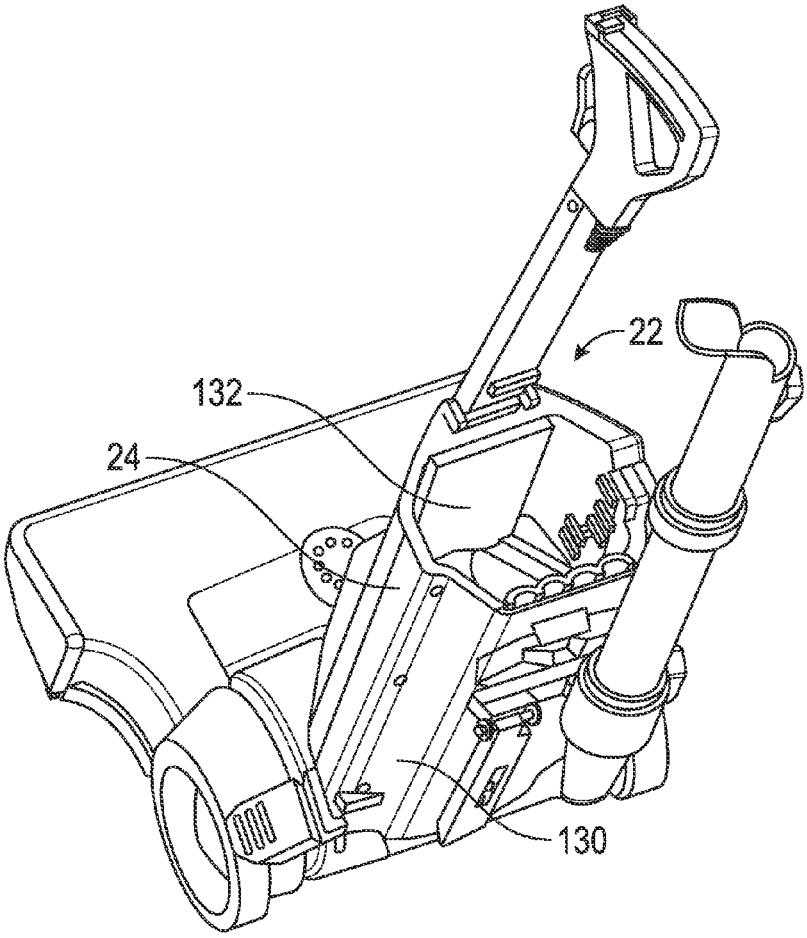
FIGS. 26-27 illustrate perspective views of portions of a particular embodiment of a filter plate of an upright vacuum cleaner utilizing certain aspects of the present inventions.
Figure 27:
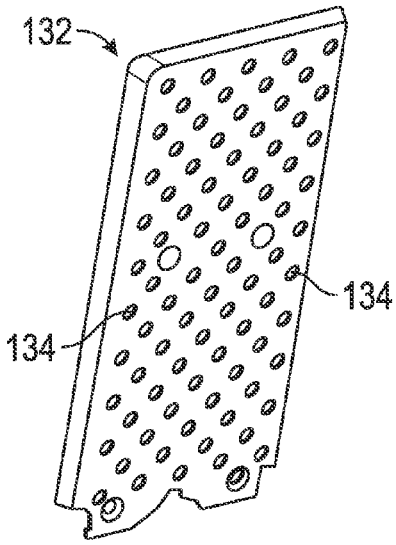

Referring also to FIGS. 26 and 27, the container 24 typically includes one or more side walls 130, the exact number of which would be dependent upon a given design and implementation. The vacuum 10 preferably includes a filter bag that fits within the side wall(s) 130 of the container. Air flowing through the container 24 is filtered by the filter bag and therefore preferably hits the fan as clean air. However, as the bag fills, less and less of its surface area is available for such airflow. Further, the filter bag may be sucked against the sidewalls 130 thereby further limiting airflow. Thus, the container assembly 22 may include one or more filter plates 132 that are offset from the sidewall(s) 130, towards the filter bag. The filter plate 132 preferably includes a plurality of holes and/or slots 134 through which the airflow may pass, thereby providing an airflow path. In this case, the airflow flows into the opening of power head 14, through the power head 14, through the extension assembly 120, into the container assembly 22, through the filter plate 132, through the main body 12, past the fan and out of the vacuum 10, in that order. Of course, other airflows are possible. For example, the airflow may flow into the opening of power head 14, through the power head 14 past the fan, through the extension assembly 120, into the container assembly 22, through the filter plate 132 and out of the vacuum 10, in that order. In some embodiments, the filter bag and/or the filter plate 130 are removable from the container assembly 22, for replacement and/or cleaning.

Other and further embodiments utilizing one or more aspects of the inventions described above can be devised without departing from the spirit of Applicant's invention. For example, the various methods and embodiments of the invention can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. An upright vacuum cleaner comprising:

a main body comprising— a motor configured to drive a fan to induce airflow through the vacuum cleaner and lift debris entrained in the airflow;

a floor engaging power head rotatably secured to the main body, the power head comprising— an opening through which the airflow enters the power head and ingests debris entrained in the airflow into the vacuum, and a brush configured to agitate the debris and thereby assist in lifting and entraining the debris in the airflow;

a main support secured to the main body and thereby rotatably secured to the power head at a first end and including— a handle at an opposing second end, and a control switch configured to selectively apply power to the motor; and a container assembly configured to filter the airflow and thereby collect the debris entrained in the airflow, the container assembly including— a container secured to the main support, a door rotatably secured to the container, and a latch assembly including a cam lock rotatably secured to the door and configured to selectively engage the main support and thereby hold the door closed, such that the door is in sealing engagement with the container, wherein the latch assembly further includes at least one stop positioned to limit rotation of the cam lock and at least one spring configured to bias the cam lock in a select position, and wherein the cam lock includes a substantially cylindrical portion about which the cam lock rotates, the cylindrical portion having an curved outer surface and at least one flat surface formed in the curved outer surface positioned to engage the spring and thereby bias the cam lock in the select position.

2. The upright vacuum cleaner of claim 1, wherein the door is colored a first color and the cam lock is colored a second color, the second color contrasting with the first color, thereby making the cam lock distinguishable from the door and operation of the latch assembly recognizable.

3. The upright vacuum cleaner of claim 1, further including a headlight assembly positioned to project light forward of the power head, the headlight assembly comprising an array of light emitting diodes (LEDs).

4. The upright vacuum cleaner of claim 3, the headlight assembly further including a lens strip and a foam backing with the LEDs of the headlight assembly secured between the foam backing and the lens strip.

5. The upright vacuum cleaner of claim 4, the power head having a forwardly facing surface with one or more apertures therein, with the LEDs positioned to project light through the lens strip and through the one or more apertures.

6. The upright vacuum cleaner of claim 1, further including— a power cord to deliver power to the motor, the cord including a first end terminating in a first plug configured to engage a power outlet, and a second end terminating in a second plug configured to engage a power inlet of the vacuum cleaner, the second plug including a strain relief having a slot therein, the slot positioned to engage a removable fastener of the vacuum cleaner, thereby securing the cord to the vacuum cleaner with the second plug and fastener installed while permitting replacement of the cord by removing the fastener.

7. The upright vacuum cleaner of claim 1, further including a motor housing containing the motor and mounted within the main body, with vibration absorbing mounts securing the motor within the housing and securing the housing within the main body.

8. The upright vacuum cleaner of claim 7, further including sound absorbing foam between the motor housing and the motor, and additional sound absorbing foam between the motor housing and the main body.

9. The upright vacuum cleaner of claim 1, further including a motor housing containing the motor and mounted within the main body, with sound absorbing foam between the motor housing and the motor, and additional sound absorbing foam between the motor housing and the main body.

10. The upright vacuum cleaner of claim 1, further including a motor housing containing the motor and mounted within the main body, the motor housing including a pressure sensor configured to indicate status information related to the airflow.

11. The upright vacuum cleaner of claim 1, wherein the motor also drives a clutch assembly which in turn drives the brush, the clutch assembly including a revolution per minute (RPM sensor) configured to indicate status information related to the brush.

12. The upright vacuum cleaner of claim 1, further including an extension assembly, the extension assembly including a flexible hose removably secured to the container assembly and a wand removably alongside the container assembly, the wand including an arcuate lip, and the container assembly including an arcuate projection positioned to engage the arcuate lip of the wand and thereby hold the in position relative to the container assembly.

13. The upright vacuum cleaner of claim 1, wherein the container assembly includes at least one side wall to contain a filter bag within the container assembly, and at least one filter plate offset from the sidewall, and between the sidewall and the filter bag.

14. The upright vacuum cleaner of claim 13, further including an extension assembly removably secured between the power head and the container assembly, wherein the airflow flows into the opening of power head, through the power head, through the extension assembly, into the container assembly, through the filter plate, through the main body, past the fan and out of the vacuum, in that order.

15. The upright vacuum cleaner of claim 13, wherein the filter bag and the filter plate are removable from the container assembly.

16. The upright vacuum cleaner of claim 1, further including a resilient gasket between the door and the container.

17. The upright vacuum cleaner of claim 16, further including a latch secured to the main support and positioned to engage the cam lock and hold the door closed, the cam lock including a wedge slidably engaging a protrusion of the latch to bias the door toward the container and compress the gasket thereby sealing the door to the container.

18. The upright vacuum cleaner of claim 1, further including a headlight assembly positioned to project light forward of the power head, the headlight assembly comprising an array of light emitting diodes (LEDs).

19. The upright vacuum cleaner of claim 18, the headlight assembly further including a lens strip and a foam backing with the LEDs of the headlight assembly secured between the foam backing and the lens strip.

20. The upright vacuum cleaner of claim 19, the power head having a forwardly facing surface with one or more apertures therein, with the LEDs positioned to project light through the lens strip and through the one or more apertures.

21. An upright vacuum cleaner comprising:

a main body comprising— a motor configured to drive a fan to induce airflow through the vacuum cleaner and lift debris entrained in the airflow;

a floor engaging power head rotatably secured to the main body, the power head comprising— an opening through which the airflow enters the power head and ingests debris entrained in the airflow into the vacuum, and a brush configured to agitate the debris and thereby assist in lifting and entraining the debris in the airflow;

a main support secured to the main body and thereby rotatably secured to the power head at a first end and including— a handle at an opposing second end, and a control switch configured to selectively apply power to the motor; and a container assembly configured to filter the airflow and thereby collect the debris entrained in the airflow, the container assembly including— a container secured to the main support, a door rotatably secured to the container, and a latch assembly including a cam lock rotatably secured to the door and configured to selectively engage the main support and thereby hold the door closed, such that the door is in sealing engagement with the container, wherein the door is colored a first color and the cam lock is colored a second color, the second color contrasting with the first color, thereby making the cam lock distinguishable from the door and operation of the latch assembly recognizable.

22. The upright vacuum cleaner of claim 21, further including— a power cord to deliver power to the motor, the cord including a first end terminating in a first plug configured to engage a power outlet, and a second end terminating in a second plug configured to engage a power inlet of the vacuum cleaner, the second plug including a strain relief having a slot therein, the slot positioned to engage a removable fastener of the vacuum cleaner, thereby securing the cord to the vacuum cleaner with the second plug and fastener installed while permitting replacement of the cord by removing the fastener.

23. The upright vacuum cleaner of claim 21, further including a motor housing containing the motor and mounted within the main body, with vibration absorbing mounts securing the motor within the housing and securing the housing within the main body.

24. The upright vacuum cleaner of claim 23, further including sound absorbing foam between the motor housing and the motor, and additional sound absorbing foam between the motor housing and the main body.

25. The upright vacuum cleaner of claim 21, further including a motor housing containing the motor and mounted within the main body, with sound absorbing foam between the motor housing and the motor, and additional sound absorbing foam between the motor housing and the main body.

26. The upright vacuum cleaner of claim 21, further including a motor housing containing the motor and mounted within the main body, the motor housing including a pressure sensor configured to indicate status information related to the airflow.

27. The upright vacuum cleaner of claim 21, wherein the motor also drives a clutch assembly which in turn drives the brush, the clutch assembly including a revolution per minute (RPM sensor) configured to indicate status information related to the brush.

28. The upright vacuum cleaner of claim 21, further including an extension assembly, the extension assembly including a flexible hose removably secured to the container assembly and a wand removably alongside the container assembly, the wand including an arcuate lip, and the container assembly including an arcuate projection positioned to engage the arcuate lip of the wand and thereby hold the in position relative to the container assembly.

29. The upright vacuum cleaner of claim 21, wherein the container assembly includes at least one side wall to contain a filter bag within the container assembly, and at least one filter plate offset from the sidewall, and between the sidewall and the filter bag.

30. The upright vacuum cleaner of claim 29, further including an extension assembly removably secured between the power head and the container assembly, wherein the airflow flows into the opening of power head, through the power head, through the extension assembly, into the container assembly, through the filter plate, through the main body, past the fan and out of the vacuum, in that order.

31. The upright vacuum cleaner of claim 29, wherein the filter bag and the filter plate are removable from the container assembly.

32. The upright vacuum cleaner of claim 21, further including a resilient gasket between the door and the container.

33. The upright vacuum cleaner of claim 32, further including a latch secured to the main support and positioned to engage the cam lock and hold the door closed, the cam lock including a wedge slidably engaging a protrusion of the latch to bias the door toward the container and compress the gasket thereby sealing the door to the container.

34. An upright vacuum cleaner comprising:

a main body comprising— a motor configured to drive a fan to induce airflow through the vacuum cleaner and lift debris entrained in the airflow;

a floor engaging power head rotatably secured to the main body, the power head comprising— an opening through which the airflow enters the power head and ingests debris entrained in the airflow into the vacuum, and a brush configured to agitate the debris and thereby assist in lifting and entraining the debris in the airflow;

a main support secured to the main body and thereby rotatably secured to the power head at a first end and including— a handle at an opposing second end, and a control switch configured to selectively apply power to the motor; and a container assembly configured to filter the airflow and thereby collect the debris entrained in the airflow, the container assembly including— a container secured to the main support, a door rotatably secured to the container, and a latch assembly including a cam lock rotatably secured to the door and configured to selectively engage the main support and thereby hold the door closed, such that the door is in sealing engagement with the container, wherein the container assembly includes at least one side wall to contain a filter bag within the container assembly, and at least one filter plate offset from the sidewall, and between the sidewall and the filter bag.

35. The upright vacuum cleaner of claim 34, further including a headlight assembly positioned to project light forward of the power head, the headlight assembly comprising an array of light emitting diodes (LEDs).

36. The upright vacuum cleaner of claim 35, the headlight assembly further including a lens strip and a foam backing with the LEDs of the headlight assembly secured between the foam backing and the lens strip.

37. The upright vacuum cleaner of claim 36, the power head having a forwardly facing surface with one or more apertures therein, with the LEDs positioned to project light through the lens strip and through the one or more apertures.

38. The upright vacuum cleaner of claim 34, further including— a power cord to deliver power to the motor, the cord including a first end terminating in a first plug configured to engage a power outlet, and a second end terminating in a second plug configured to engage a power inlet of the vacuum cleaner, the second plug including a strain relief having a slot therein, the slot positioned to engage a removable fastener of the vacuum cleaner, thereby securing the cord to the vacuum cleaner with the second plug and fastener installed while permitting replacement of the cord by removing the fastener.

39. The upright vacuum cleaner of claim 34, further including a motor housing containing the motor and mounted within the main body, with vibration absorbing mounts securing the motor within the housing and securing the housing within the main body.

40. The upright vacuum cleaner of claim 39, further including sound absorbing foam between the motor housing and the motor, and additional sound absorbing foam between the motor housing and the main body.

41. The upright vacuum cleaner of claim 34, further including a motor housing containing the motor and mounted within the main body, with sound absorbing foam between the motor housing and the motor, and additional sound absorbing foam between the motor housing and the main body.

42. The upright vacuum cleaner of claim 34, further including a motor housing containing the motor and mounted within the main body, the motor housing including a pressure sensor configured to indicate status information related to the airflow.

43. The upright vacuum cleaner of claim 34, wherein the motor also drives a clutch assembly which in turn drives the brush, the clutch assembly including a revolution per minute (RPM sensor) configured to indicate status information related to the brush.

44. The upright vacuum cleaner of claim 34, further including an extension assembly, the extension assembly including a flexible hose removably secured to the container assembly and a wand removably alongside the container assembly, the wand including an arcuate lip, and the container assembly including an arcuate projection positioned to engage the arcuate lip of the wand and thereby hold the in position relative to the container assembly.

45. The upright vacuum cleaner of claim 34, further including an extension assembly removably secured between the power head and the container assembly, wherein the airflow flows into the opening of power head, through the power head, through the extension assembly, into the container assembly, through the filter plate, through the main body, past the fan and out of the vacuum, in that order.

46. The upright vacuum cleaner of claim 34, wherein the filter bag and the filter plate are removable from the container assembly.

47. The upright vacuum cleaner of claim 34, further including a resilient gasket between the door and the container.

48. The upright vacuum cleaner of claim 47, further including a latch secured to the main support and positioned to engage the cam lock and hold the door closed, the cam lock including a wedge slidably engaging a protrusion of the latch to bias the door toward the container and compress the gasket thereby sealing the door to the container.

49. An upright vacuum cleaner comprising:

a main body comprising— a motor configured to drive a fan to induce airflow through the vacuum cleaner and lift debris entrained in the airflow;

a floor engaging power head rotatably secured to the main body, the power head comprising— an opening through which the airflow enters the power head and ingests debris entrained in the airflow into the vacuum, and a brush configured to agitate the debris and thereby assist in lifting and entraining the debris in the airflow;

a main support secured to the main body and thereby rotatably secured to the power head at a first end and including— a handle at an opposing second end, and a control switch configured to selectively apply power to the motor;

a container assembly configured to filter the airflow and thereby collect the debris entrained in the airflow, the container assembly including— a container secured to the main support, a door rotatably secured to the container, and a latch assembly including a cam lock rotatably secured to the door and configured to selectively engage the main support and thereby hold the door closed, such that the door is in sealing engagement with the container;

a resilient gasket between the door and the container; and a latch secured to the main support and positioned to engage the cam lock and hold the door closed, the cam lock including a wedge slidably engaging a protrusion of the latch to bias the door toward the container and compress the gasket thereby sealing the door to the container.

50. The upright vacuum cleaner of claim 49, further including a headlight assembly positioned to project light forward of the power head, the headlight assembly comprising an array of light emitting diodes (LEDs).

51. The upright vacuum cleaner of claim 50, the headlight assembly further including a lens strip and a foam backing with the LEDs of the headlight assembly secured between the foam backing and the lens strip.

52. The upright vacuum cleaner of claim 51, the power head having a forwardly facing surface with one or more apertures therein, with the LEDs positioned to project light through the lens strip and through the one or more apertures.

53. The upright vacuum cleaner of claim 49, further including— a power cord to deliver power to the motor, the cord including a first end terminating in a first plug configured to engage a power outlet, and a second end terminating in a second plug configured to engage a power inlet of the vacuum cleaner, the second plug including a strain relief having a slot therein, the slot positioned to engage a removable fastener of the vacuum cleaner, thereby securing the cord to the vacuum cleaner with the second plug and fastener installed while permitting replacement of the cord by removing the fastener.

54. The upright vacuum cleaner of claim 49, further including a motor housing containing the motor and mounted within the main body, with vibration absorbing mounts securing the motor within the housing and securing the housing within the main body.

55. The upright vacuum cleaner of claim 54, further including sound absorbing foam between the motor housing and the motor, and additional sound absorbing foam between the motor housing and the main body.

56. The upright vacuum cleaner of claim 49, further including a motor housing containing the motor and mounted within the main body, with sound absorbing foam between the motor housing and the motor, and additional sound absorbing foam between the motor housing and the main body.

57. The upright vacuum cleaner of claim 49, further including a motor housing containing the motor and mounted within the main body, the motor housing including a pressure sensor configured to indicate status information related to the airflow.

58. The upright vacuum cleaner of claim 49, wherein the motor also drives a clutch assembly which in turn drives the brush, the clutch assembly including a revolution per minute (RPM sensor) configured to indicate status information related to the brush.

59. The upright vacuum cleaner of claim 49, further including an extension assembly, the extension assembly including a flexible hose removably secured to the container assembly and a wand removably alongside the container assembly, the wand including an arcuate lip, and the container assembly including an arcuate projection positioned to engage the arcuate lip of the wand and thereby hold the in position relative to the container assembly.

* * * * *